US005380150A

United States Patent [19]

Stahl

[11] Patent Number: 5,380,150

[45] Date of Patent: Jan. 10, 1995

[54] TURBINE SHROUD SEGMENT

[75] Inventor: Matthew Stahl, College Station, Tex.

[73] Assignee: United Technologies Corporation, Hartford, Conn.

[21] Appl. No.: 151,258

[22] Filed: Nov. 8, 1993

[51] Int. Cl.[6] ..... F01D 11/08; F01D 9/00; F02C 7/12

[52] U.S. Cl. ..... 415/139; 415/116

[58] Field of Search ..... 415/117, 116, 115, 139, 415/134

[56] References Cited

U.S. PATENT DOCUMENTS

| | | | |
|---|---|---|---|
| 3,365,172 | 1/1968 | McDonough et al. | 253/39.15 |
| 3,583,824 | 6/1971 | Smuland et al. | 415/117 |
| 3,728,039 | 4/1973 | Plemmons et al. | 415/115 |
| 4,013,376 | 3/1977 | Bisson et al. | 415/117 |
| 4,311,432 | 1/1982 | Kildea | 415/134 |
| 4,497,610 | 2/1985 | Richardson et al. | 415/116 |
| 4,573,865 | 3/1986 | Hsia et al. | 415/115 |
| 4,642,024 | 2/1987 | Weidner | 415/116 |
| 4,752,184 | 6/1988 | Liang | 415/116 |
| 4,992,025 | 2/1991 | Stroud et al. | 416/97 R |
| 5,088,888 | 2/1992 | Bobo | 415/170.1 |
| 5,165,847 | 11/1992 | Proctor et al. | 415/115 |
| 5,167,485 | 12/1992 | Starkweather | 415/115 |
| 5,167,487 | 12/1992 | Rock | 415/173.3 |
| 5,167,488 | 12/1992 | Ciokajlo et al. | 415/175 |
| 5,169,287 | 12/1992 | Proctor et al. | 415/115 |
| 5,318,402 | 6/1994 | Bailey et al. | 415/139 |

FOREIGN PATENT DOCUMENTS

| | | | |
|---|---|---|---|
| 8302102 | 8/1984 | France | F02C 7/12 |
| 153504 | 7/1987 | Japan | F01D 11/08 |

*Primary Examiner*—David Brown

[57] ABSTRACT

A turbine shroud segment includes a center hook along one edge which retains the segment to the turbine structure while permitting thermal distortion of the segment. In a particular embodiment, a segment includes a pair of spaced center hooks, a first lateral hook, and a second lateral hook disposed oppositely of the first lateral hook. The spaced center hooks retain the segment and prevent radially inward movement of the center region of the segment. The lateral hooks provide supplemental retention while permitting the lateral edges of the segment to move radially outward in response to thermal distortion of the segment.

8 Claims, 3 Drawing Sheets

TURBINE SHROUD SEGMENT

TECHNICAL FIELD

This invention relates to gas turbine engines, and more particularly to shroud segments for gas turbine engines.

BACKGROUND OF THE INVENTION

A conventional axial flow gas turbine engine includes an array of turbine blades which extend through a flow path for hot gases, or working fluid, exiting a combustion section. As a result of the engagement with the working fluid flowing through the flowpath, the array of blades rotate about a longitudinal axis of the gas turbine engine. Efficient operation of the turbine requires minimizing the amount of working fluid which bypasses the turbine blades as the working fluid flows through the turbine. One method of accomplishing this is to provide an annular shroud which extends about the array of turbine blades in close radial proximity to the radially outward tips of the turbine blades. Modern gas turbine engines typically use shrouds comprised of a plurality of segments which are circumferentially aligned to form the annular shroud.

Each shroud segment includes a substrate having means to retain the segment to the support structure of the turbine section and a flow surface facing the blade tips and exposed to the working fluid. In order to minimize the gaps between the flow surface and the blade tips, the flow surface may include an abradable coating. The abradable coating permits the blade tips to make contact with the segments during operation without damaging the blades. In effect, the blades and segments are tolerant of thermal growth during operation without significantly degrading efficiency.

Since the shroud segment is in contact with the hot gases of the working fluid, means to maintain the shroud segment within acceptable temperature limits is required. One means of cooling the segments is to flow some of the compressor fluid directly to the segments. This cooling fluid impinges upon the radially outer surface of the shroud segment and removes some heat from the segment. Another technique to minimize the temperature of the segment is to form the abradable layer from a ceramic material. The ceramic abradable coating provides insulation between the hot working fluid and the substrate. Further techniques include film cooling the abradable layer.

The means of retention is typically a hook type structure, either a plurality of individual hooks or a circumferentially extending rail, disposed on the upstream and downstream ends of the segment. The retention means engages with the support structure to radially retain the segment. The support structure may also include a pin which engages with an accommodating cut-out in the segment to position the segment laterally.

Sealing mechanisms are used to prevent cooling fluid from bypassing the segment and flowing between adjacent segments or between the segments and the support structure. Conventional sealing mechanisms for segments include feather seals and 'W' seals. Feather seals extend laterally between adjacent segments to seal this opening. 'W' seals are disposed between the segments and the support structure to seal this opening. The 'W' seals usually require a laterally extending sealing surface on the segment to engage the 'W' seal. Due the presence of this sealing surface along the axial edges, the hooks and rails extend further outward from the substrate and present a larger profile.

Shroud segments, since they are exposed to extreme temperatures and abrasive contact from the rotating blades, are replaced frequently. A large temperature gradient may exist between the radially outer surfaces of the substrate, exposed to cooling fluid, and the flow surface, which is exposed to the working fluid. The temperature gradient and the thermal expansion that results from it cause the segment to distort. This distortion may increase the destructive contact between the segment and the blade. Another problem occurs, however, if the segment is stiffened, such as by having an extending rail. Even if spaced hooks are used, which are inherently more flexible than an extending rail, may not permit sufficient flexibility especially if the presence of a 'W' seal requires large profile hooks be used. In this case, compressive stresses may be induced in the substrate and the ceramic abradable layer as a result of the segment not being permitted to distort enough to accommodate the thermal deflection. This may lead to cracking of the substrate, the abradable layer, or both. Another concern is the size and weight of the segments.

One possible solution is to remove the 'W' seal and have short, individual hooks as the retaining means. This would provide insufficient sealing and require additional cooling fluid be drawn from the compressor. Another solution is to have a continuous rail which fits snugly within the support structure to provide the needed sealing. This configuration, however, would not accommodate thermal growth of the segment and would result in thermal stress related damage to the segment or support structure. Having a loose fitting rail and accepting some cooling fluid loss would accommodate some thermal expansion, but would introduce a variation in the radial positioning of the segment. This variation would produce larger radial gaps between the blade and the shroud and result in less efficient engagement between the blades and the working fluid.

The above art notwithstanding, scientists and engineers under the direction of Applicants' Assignee are working to develop thin, flexible shroud segments which distort under operating conditions without degrading performance of the gas turbine engine.

DISCLOSURE OF THE INVENTION

This invention was predicated in part upon the recognition that the greatest wear of shroud segments was occurring in the axial center region as a result of the thermal distortion of the segments. As the segment heats up, the layer of abradable coating expands faster than the underlying substrate. This difference causes the segment to flatten or distort away from the arcuate shape of the segment in the non-operational condition. As a consequence, the center region moves radially inward and increases the likelihood of abrading contact between the segment and the rotating blades. Preventing this distortion by stiffening the segment reduces abrading contact but induces compressive stresses in the coating which lead to cracking and loss of coating layer.

According to the present invention, a shroud segment includes at least one hook which engages support structure to prevent radially inward movement of the center of the segment while permitting distortion of the segment in response to thermal conditions.

According to a particular embodiment of the present invention, the segment includes a center hook and a pair of side hooks disposed on opposite sides of the center hook. The center hook is adapted to retain the center region of the segment against radially inward movement. The side hooks prevents excessive rotation or rocking of the segment about an axially oriented central axis and provide supplemental retention of the segment.

According to another particular embodiment of the present invention, the center hook is comprised of two separate portions each of which are circumferentially spaced from the other and from the central axis. Each portion retains the center region of the segment from radially inward movement. Neither portion, however, is directly over the central axis.

A principle feature of the present invention is the individual hook disposed in the center region of the segment. A feature of a particular embodiment is the pair of side hooks disposed near the edges of the segment and on opposite sides of the center hook. A feature of another particular embodiment is the split center hook having two spaced portions.

A primary advantage of the present invention is extended life of the abradable layer, and thereby the shroud segment, as a result of the low stresses in the abradable layer and the minimal abrasive contact in the center region of the segment. The lower stresses result from the improved flexibility of the segment. The hook or hooks permit the segment to bend or distort to accommodate the greater thermal expansion of the abradable layer as compared to the substrate. Distortion of the segment reduces compressive stress in the abradable layer. The minimal abrasive contact results from the hook preventing the center region of the segment from radially inward movement while the lateral regions of the segment are permitted to move radially outward, i.e. the segment is permitted to flatten without the center region moving radially inward. Another advantage of present invention is the increased efficiency of the gas turbine engine as a result of minimizing gap size between the blades and the segments. Reducing abrasive contact between the blade and segment reduces wear of the abradable layer, thereby minimizing the gap and the amount of working fluid which escapes around the blade. Further advantages of the present invention include reduced weight, supplemental retention provided by the side hooks, and stabilization of the segment provided by the side hooks.

The foregoing and other objects, features and advantages of the present invention become more apparent in light of the following detailed description of the exemplary embodiments thereof, as illustrated in the accompanying drawings.

BEST MODE FOR CARRYING OUT THE INVENTION

Figure 1:
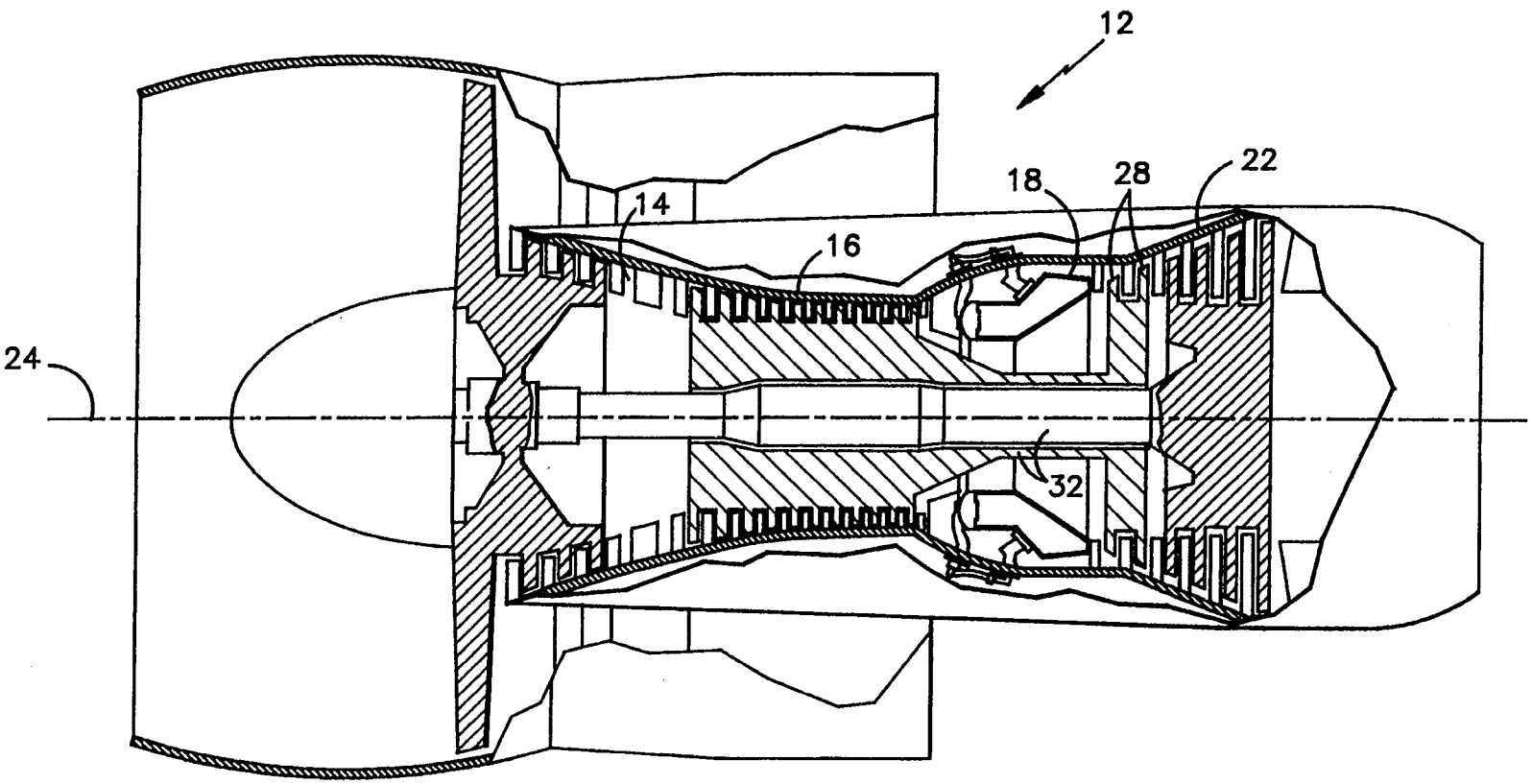
FIG. 1 is a side view of a gas turbine engine, partially cut away and sectioned to show a compressor section, a combustor, and a turbine section.

Referring now to FIG. 1, a gas turbine engine 12 includes a compressor section 16, a combustor 18, and a turbine section 22. The gas turbine engine 12 is disposed about a longitudinal axis 24 and includes an annular, axially oriented flowpath 14 which extends through the compressor section 16, combustor 18, and turbine section 22. Working fluid enters the compressor section 16 where work is performed upon the working fluid to add energy in the form of increased momentum. The working fluid exits the compressor section 16 and enters the combustor 18 wherein fuel is mixed with the working fluid. The mixture is ignited in the combustor 18 to add further energy to the working fluid. The combustion process results in raising the temperature of the working fluid exiting the combustor 18 and entering the turbine section 22. Within the turbine section 22, the working fluid engages a plurality of rotor assemblies 28 to transfer energy from the hot gases of the working fluid to the rotor assemblies 28. A portion of this transferred energy is then transmitted back to the compressor section 16 via a rotating shaft 32. The remainder of the transferred energy may be used for other functions.

Figure 2:
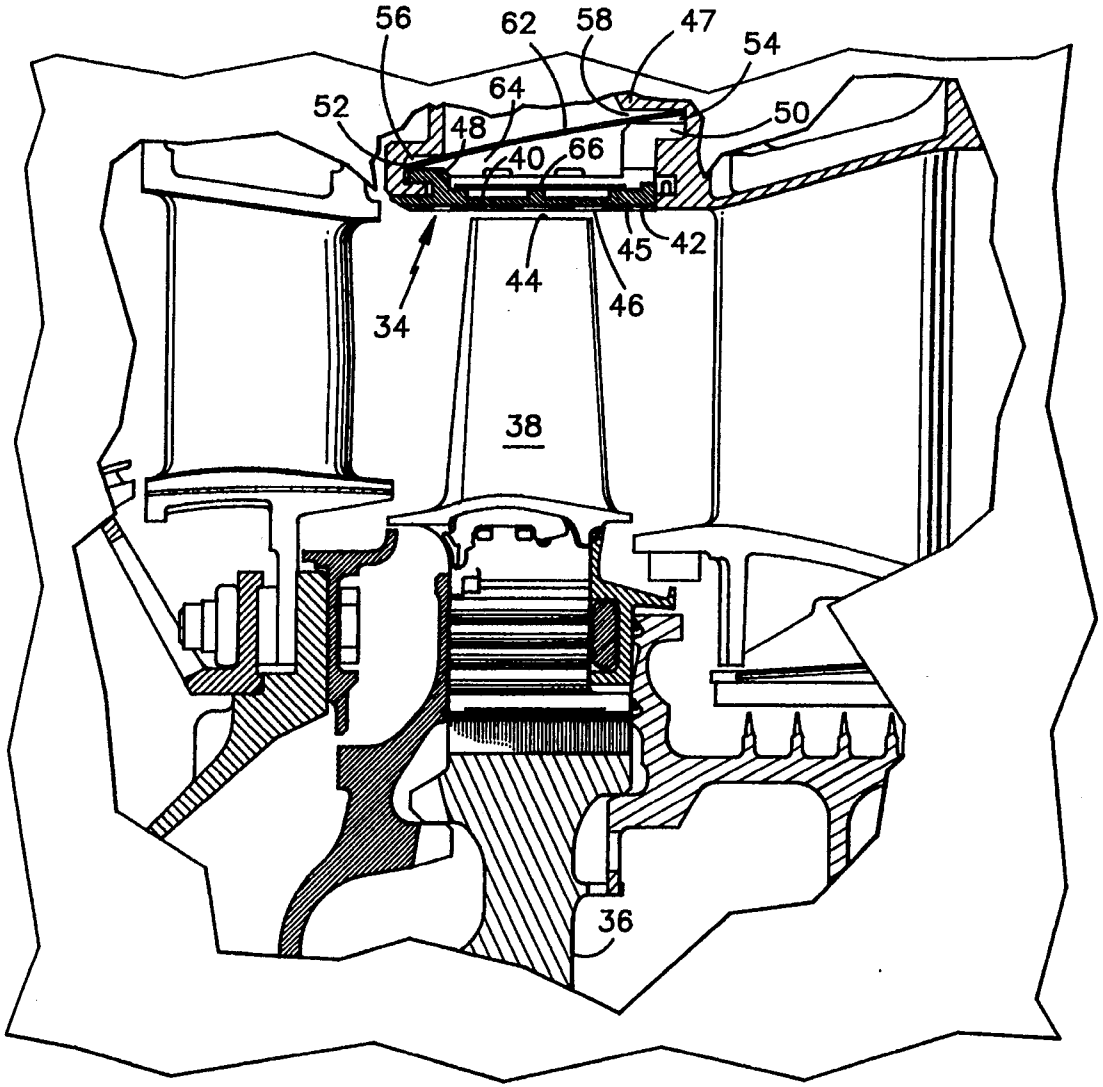
FIG. 2 is a side view of a first stage turbine rotor assembly and a turbine shroud.

Referring now to FIG. 2, the rotor assembly 28 and a turbine shroud 34 are illustrated. The rotor assembly 28 includes a disk 36 and a plurality of rotor blades 38 disposed about the outer periphery of the disk 36. The turbine shroud 34 is disposed radially outward of the plurality of rotor blades 38. The turbine shroud 34 includes a plurality of circumferentially adjacent segments 40. The segments 40 form an annular ring having a flow surface 42 in radial proximity to the radially outer tips 44 of the plurality of rotor blades 38.

Each of the segments 40 includes a substrate 45 and an abradable layer 46. Each segment 40 is engaged with turbine structure 47 and include means to radially and axially retain the segment in proper position. The retaining means on the axially forward edge of this segment includes a low profile rail 48. The retaining means on the aft section includes a plurality of hooks 50. Hooks, rather than a rail, are used along the aft edge because of the greater pressure differences along the aft edge than along the forward edge. The greater pressure difference results from having an axially constant pressure outward of the segment (from the cooling fluid) and an axially decreasing pressure inward of the segment.

Both the rail 48 and the hooks 50 are engaged with one of a pair of recesses 52,54 in the turbine structure 47 to provide radial retention of the segment 40. The radial width of both the rail 48 and each of the hooks 50 is substantially less than the radial width of the recess 52,54 with which it is engaged to define a pair of radial gaps 56,58. A band 62 is disposed within both the forward gap 56 and the aft gap 58. The band 62 engages both the turbine structure 47 and the segment 40 via the rail 48 and the aft hooks 50. The band 62 provides means to resiliently mount the segment 40 in the radial direction.

Cooling fluid flows radially inward from passages (not shown) within the turbine structure 47, through openings in the band 62 and into a cavity 64 defined between the band 62 and the radially outer surface 66 of the segment 40. This cooling fluid then flows through impingement holes 68 (see FIG. 4) in the radially outer surface 66 and impinges upon the substrate 45. This cooling fluid maintains the segment 40 within acceptable temperature limits.

Figure 3:
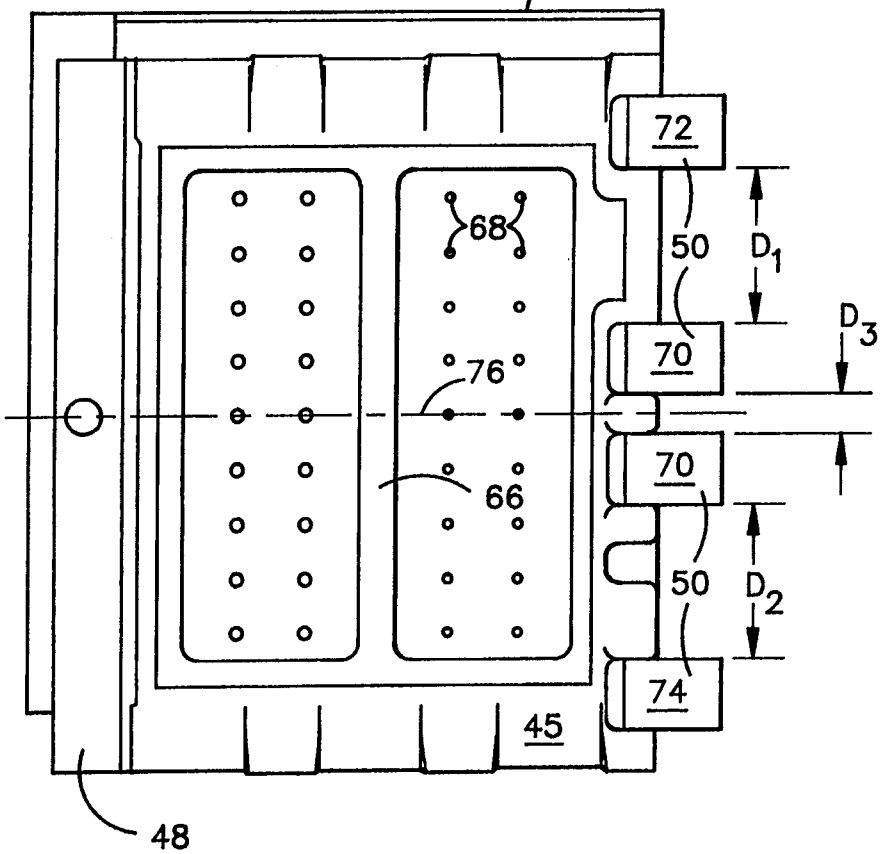
FIG. 3 is a top view of a shroud segment.

Referring now to FIG. 3, the plurality of hooks 50 include a pair of closely spaced center hooks 70, a first lateral hook 72 and a second lateral hook 74. The center hooks 70 are spaced about an axially directed central axis 76 of the segment 40 such that neither hook is directly over the central axis 76. The lateral hooks 72,74 are disposed on opposite lateral edges and spaced a substantially greater distance $D_1$, $D_2$ from the center hooks 70 than the spacing $D_3$ between the center hooks 70.

The center hooks 70 provide means to retain the segment 40 to the turbine structure 47 and to prevent the center region of the segment 40 from moving radially inward. Although shown in FIG. 3 and described above as a pair of center hooks, a single center hook may be used to provide both the retention means and the means to prevent inward movement. Spaced center hooks, however, provide additional flexibility to the segment 40 without a loss in strength to react forces urging the segment 40 radially inward. Further, not having any hooks over the central axis 76, which is a region subjected to the high bending stresses, maximizes the flexibility of the segment in response to the thermal stresses.

The lateral hooks 72,74 provide means to prevent the segment 40 from rotating or teetering about the center hooks 70, and therefore the lateral hooks 72,74 prevent excessive movement of the lateral edges. Although the lateral hooks 72,74 may not be required, excessive rotation could result in one lateral edge moving radially inward sufficiently to cause contact with the rotating blades 38. Such contact may result in destructive wear of the segment 40 and/or blades 38. The lateral hooks 72,74 also provide means of supplemental retention of the segment 40 in the event that the center hooks 70 should fail to retain the segment 40. The lateral hooks 72,74 fit loosely within the recess 58 of the turbine structure 47 to permit the segment 40 to deform in response to the thermal stresses which occur during operation.

Figure 5:
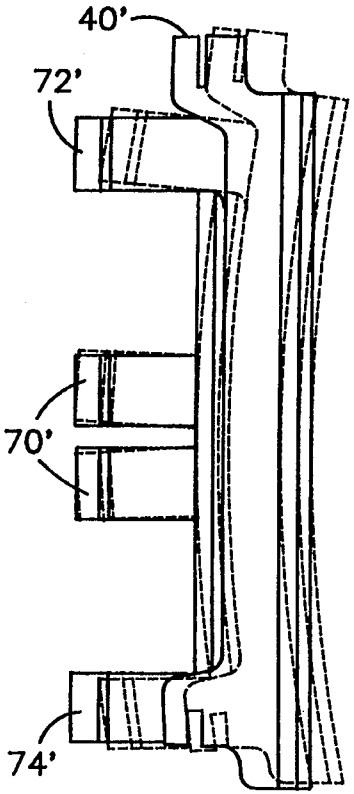
FIG. 5 is a side view of the shroud segment after heating, with the dashed outline indicating the unheated shroud segment.
Figure 4:
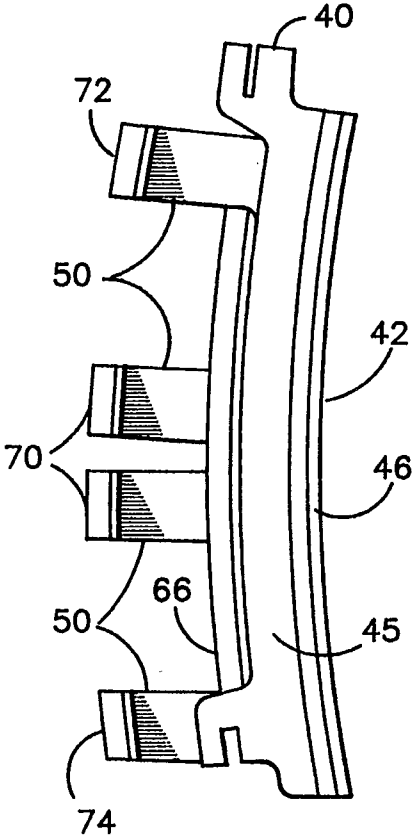
FIG. 4 is a side view of the shroud segment.

During operation, hot working fluid flows over the abradable layer 46 of the segment 40 and causes the segment 40 to heat. Since the abradable layer 46 is in direct contact with the hot working fluid, and since the abradable coatings typically used have a greater coefficient of expansion than the metallic substrates, the abradable layer 46 expands faster than the substrate 45 material. As illustrated in FIGS. 4 and 5, the segment 40 attempts to flatten out to accommodate the thermal stress between the abradable layer 46 and the substrate 45. FIG. 4 illustrates the unheated, arcuate shape of the segment 40 and FIG. 5 illustrates the segment 40 after distortion due to heating.

If the segment 40 is retained too rigidly, it will not permit the flattening to occur. This will amplify the thermal stress within the segment 40 and between the abradable layer 46 and the substrate 45. The thermal stress may cause cracking in the abradable layer 46 substrate 45 or abradable layer 46, or may cause to chip away or separate from the substrate 45. If the segment 40 includes evenly spaced hooks which retain the segment loosely such that flattening is permitted to occur, the center region may be forced radially inward toward the rotating blade tips. Excessive radially inward movement will cause excessive wear in the center region of the segment.

In a segment in accordance with the invention, however, the segment 40 is retained by the center hook 70 and excessive radially inward movement of the region about the central axis 76 is prevented. The segment 40 may flatten out by having the lateral edges move radially outward and away from the rotating blade tips 44. In addition, since there are a minimum of hooks, the flexibility of the segment 40 is maximized and the thermal stresses between the abradable layer 46 and the substrate 45 is minimized. If a pair of spaced center hooks 70 are used, such as shown in FIGS. 1–5, the flexibility of the segment 40 in response to thermal growth is further supplemented.

Although the invention has been shown and described with respect with exemplary embodiments thereof, it should be understood by those skilled in the art that various changes, omissions, and additions may be made thereto, without departing from the spirit and scope of the invention.

What is claimed is:

1. A shroud segment for use in a gas turbine engine, the gas turbine engine being disposed about a longitudinal axis, the gas turbine engine including support structure and a fluid passage defining a flow path for working fluid, the segment being arcuate and having an installed condition wherein the segment is retained to the support structure and extends in a circumferential direction about the longitudinal axis, the segment including:

a substrate having a central axis, a flow surface, and a radially outer surface, the flow surface facing radially inward in the installed condition such that the flow surface is exposed to the working fluid, the radially outer surface facing radially outward in the installed condition and exposed to fluid which is relatively cooler than the working fluid, wherein the temperature difference between the flow surface and the radially outer surface encourages the arcuate segment to distort away from the circumferential direction;

means to retain the segment to the support structure, the retaining means including a center hook which blocks radially inward movement of the region about the central axis of the substrate, and wherein the retaining means permits distortion of the installed segment such that the lateral ends of the segment move radially outward.

2. The shroud segment according to claim 1, wherein the retaining means includes the center hook and a pair of lateral hooks, each of the pair of lateral hooks disposed on opposite lateral ends of the substrate, and wherein the pair of lateral hooks are loosely retained within the support structure to permit the segment to distort during operation of the gas turbine engine such that the lateral ends may move radially outward.

3. The shroud segment according to claim 1, wherein the retaining means includes a second center hook, wherein the first center hook and the second center hook are disposed on opposite sides of the central axis such that no hook is directly over the central axis.

4. The shroud segment according to claim 3, wherein the retaining means includes the first center hook, the second center hook, and a pair of lateral hooks, each of the pair of lateral hooks disposed on opposite lateral ends of the substrate, and wherein the pair of lateral hooks are loosely retained within the support structure to permit the segment to distort during operation of the gas turbine engine such that the lateral ends may move radially outward.

5. A shroud for a gas turbine engine, the gas turbine engine being disposed about a longitudinal axis, the gas turbine engine including support structure and a fluid passage defining a flow path for working fluid, the shroud extending about and defining a portion of the flow path, the shroud including a plurality of shroud segments, each of the segments being arcuate and having an installed condition wherein the segment is retained to the support structure and extends in a circumferential direction about the longitudinal axis, wherein each segment includes:

a substrate having a central axis, a flow surface, and a radially outer surface, the flow surface facing radially inward in the installed condition such that the flow surface is exposed to the working fluid, the radially outer surface facing radially outward in the installed condition and exposed to fluid which is relatively cooler than the working fluid, wherein the temperature difference between the flow surface and the radially outer surface encourages the arcuate segment to distort away from the circumferential direction;

means to retain the segment to the support structure, the retaining means including a center hook which blocks radially inward movement of the region about the central axis of the substrate, and wherein the retaining means permits distortion of the installed segment such that the lateral ends of the segment move radially outward.

6. The shroud segment according to claim 5, wherein the retaining means includes the center hook and a pair of lateral hooks, each of the pair of lateral hooks disposed on opposite lateral ends of the substrate, and wherein the pair of lateral hooks are loosely retained within to permit the segment to distort during operation of the gas turbine engine such that the lateral ends may move radially outward.

7. The shroud segment according to claim 5, wherein the retaining means includes a second center hook, wherein the first center hook and the second center hook are disposed on opposite sides of the central axis such that no hook is directly over the central axis.

8. The shroud segment according to claim 7, wherein the retaining means includes the first center hook, the second center hook, and a pair of lateral hooks, each of the pair of lateral hooks disposed on opposite lateral ends of the substrate, and wherein the pair of lateral hooks are loosely retained within the support structure to permit the segment to distort during operation of the gas turbine engine such that the lateral ends may move radially outward.

* * * * *